US006246373B1

(12) United States Patent
Aoki

(10) Patent No.: US 6,246,373 B1
(45) Date of Patent: Jun. 12, 2001

(54) ANTENNA DEVICE

(75) Inventor: Kouta Aoki, Kanagawa (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/447,177

(22) Filed: Nov. 22, 1999

(30) Foreign Application Priority Data

Nov. 30, 1998 (JP) ..... 10-339953

(51) Int. Cl.[7] ..... H01Q 1/24
(52) U.S. Cl. ..... 343/702; 343/895
(58) Field of Search ..... 343/702, 895, 343/906; H01Q 1/24

(56) References Cited

U.S. PATENT DOCUMENTS 5,317,325 * 5/1994 Bottomley ..... 343/702
5,467,096 * 11/1995 Takamoro et al. ..... 343/895
5,856,808 * 1/1999 Holshouser et al. ..... 343/702
5,969,684 * 10/1999 Oh et al. ..... 343/702

* cited by examiner

*Primary Examiner*—Hoanganh Le
(74) *Attorney, Agent, or Firm*—Pearne & Gordon LLP

(57) ABSTRACT

An antenna device capable of securing the space for disposing a conductor element easily in view of the trend of downsizing, without the need of a step for the conductance with other electric devices. An antenna feeder part comes in contact with a feeding spring at the time of contraction so that a helical part can function as an antenna as well as a conductor element is provided elongating along an antenna storage part in the space in the housing for capacitive coupling with the antenna feeder part so that the antenna gain is improved by the conductor element. Therefore, even when the radiation of the helical part is restrained by the influence of a human head part, in particular, of an earlobe, since the conductor element is the radiation source, it is easy to secure the space as well as a step for the conductance with other electric devices is not required, and restraint of the radiation by the human head part can be alleviated for the antenna device as a whole so that the antenna gain can be improved.

8 Claims, 5 Drawing Sheets

ANTENNA DEVICE

BACKGROUND OF THE INVENTION

The present invention relates to an antenna device, in particular, it relates to one capable of having good communication even in the case the antenna characteristic is deteriorated due to the influence of a human body on the antenna.

Japanese Patent Application 10-160026, which was filed by the present inventor, discloses "antenna devices comprising a fixed (retractable) antenna provided with a shield case in a housing, comprising a conductor element conductive with the shield case inside the housing so that the antenna gain is improved by the conductor element". Among them, an antenna device comprising a fixed antenna provided with a shield case inside a housing will be explained with reference to FIGS. 5A and 5B.

The antenna device shown in FIGS. 5A and 5B are a partial view of the part in the vicinity of the antenna device of a portable radio terminal device, such as PHS. FIG. 5A is a plan view of the rear side of the portable radio terminal device, and FIG. 5B is a side view thereof. In FIGS. 5A and 5B, the antenna device comprises a fixed antenna having a helical part 11 provided with an helical antenna element functioning as a radiation element in an antenna cover, and a connection part 12 provided in a housing 14, to be connected with the helical antenna element of the helical element part, a high frequency feeder part having a matching circuit part 16 provided in the housing 14, to be connected via a feeder piece 15 to be a feeding point 13 of the antenna, and a radio circuit part 20 to be connected with the matching circuit part 16, a shield case 19 for shielding a radiated unnecessary electromagnetic wave, and a conductor element 17 to be connected with the shield case at a contact part 18.

The conductor element 17 provided inside the housing 14 is connected with the ground of the radio circuit part 20 via the contact part 18 and the shield case 19 such that the ground electric current dispersed in the shield case 19 and the radio circuit part 20 is gathered so as to serve as a radiation element.

The matching circuit part 16 matches the impedance between the radio circuit part 20 and a radiation element comprising the helical element part 11 and the conductor element 15 for transmitting the electric power from the radio circuit part 20 to the radiation element without reflection.

The conductor element 17 has a comb teeth-like shape, with one of the comb teeth bent such that the connection part 12 of the fixed antenna is accommodated in the bent part. The radio circuit part 20 is disposed in the shield case 19.

As mentioned above, the antenna device of the prior application provided with a conductor element conductive with the shield case inside the housing for improving the antenna gain by the conductor element gave rise to a problem in that a step for the conductance with other electric devices is required as well as it is difficult to secure the space for accommodating the conductor element in view of the trend of downsizing of the device.

SUMMARY OF THE INVENTION

Accordingly, an object of the invention is to provide an antenna device capable of securing the space for accommodating a conductor element in view of the trend of downsizing of the device, without requiring the step for the conductance with other electric devices (antenna, shield case).

In order to solve the problems, in the invention, an antenna feeder part comes in contact with a feeding spring at the time of contraction so that a helical part can function as an antenna as well as a conductor element is provided elongating along an antenna storage part in the space in the housing for capacitive coupling with the antenna feeder part so that the antenna gain is improved by the conductor element.

Accordingly, even when the radiation of the helical part is restrained by the influence of a human head part, in particular, of an earlobe, since the conductor element is the radiation source, it is easy to secure the space as well as a step for the conductance with other electric devices is not required, and restraint of the radiation by the human head part can be alleviated for the antenna device as a whole so that the antenna gain can be improved.

Since a first aspect of the invention is an antenna device comprising a retractable antenna provided with a shield case in a housing, wherein an antenna feeder part comes in contact with a feeding spring at the time of contraction so that a helical part can function as an antenna as well as a conductor element is provided elongating along an antenna storage part in the space in the housing for capacitive coupling with the antenna feeder part so that the antenna gain is improved by the conductor element, it is advantageous in that it is easy to secure the space as well as a step for the conductance with other electric devices is not required, and restraint of the radiation by the human head part can be alleviated for the antenna device as a whole so that the antenna gain can be improved.

Moreover, since a second aspect of the invention is the antenna device according to the first aspect, wherein the conductor element is disposed with a three-dimensional shape along the antenna storage part for allowing further capacitive coupling with the antenna feeder part, it is advantageous in that it is easy to secure the space as well as a step for the conductance with other electric devices is not required, and restraint of the radiation by the human head part can be alleviated for the antenna device as a whole so that the antenna gain can be improved.

Furthermore, since a third aspect of the invention is an antenna device comprising a fixed antenna provided with a shield case in a housing, wherein an antenna feeder part contacts with a feeding spring so that a helical part can function as an antenna as well as a conductor element is provided elongating along a prolongation of the antenna feeder part in the space in the housing for capacitive coupling with the antenna feeder part so that the antenna gain is improved by the conductor element, it is advantageous in that it is easy to secure the space as well as a step for the conductance with other electric devices is not required, and restraint of the radiation by the human head part can be alleviated for the antenna device as a whole so that the antenna gain can be improved.

Moreover, since a fourth aspect of the invention is the antenna device according to the third aspect, wherein the conductor element is disposed with a three-dimensional shape along the antenna storage part for allowing further capacitive coupling with the antenna feeder part, it is advantageous in that it is easy to secure the space as well as a step for the conductance with other electric devices is not required, and restraint of the radiation by the human head part can be alleviated for the antenna device as a whole so that the antenna gain can be improved.

Furthermore, since a fifth aspect of the invention is portable radio terminal device comprising the antenna device according to the first aspect or the third aspect, it is advantageous in that the antenna gain can be improved in the portable radio terminal device.

Moreover, since a sixth aspect of the invention is a portable radio phone device comprising the antenna device according to the first aspect or the third aspect, it is advantageous in that the antenna gain can be improved in the portable radio phone device.

DETAILED DESCRIPTION OF THE INVENTION

Hereinafter an embodiment of the invention will be explained with reference to FIGS. 1 to 3.

Figure 1A:
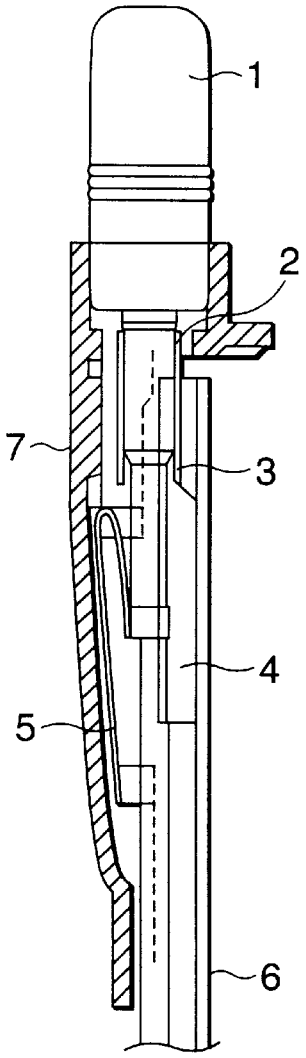
FIGS. 1A and 1B are block diagrams showing the configuration of an antenna device according to the invention.
Figure 1B:
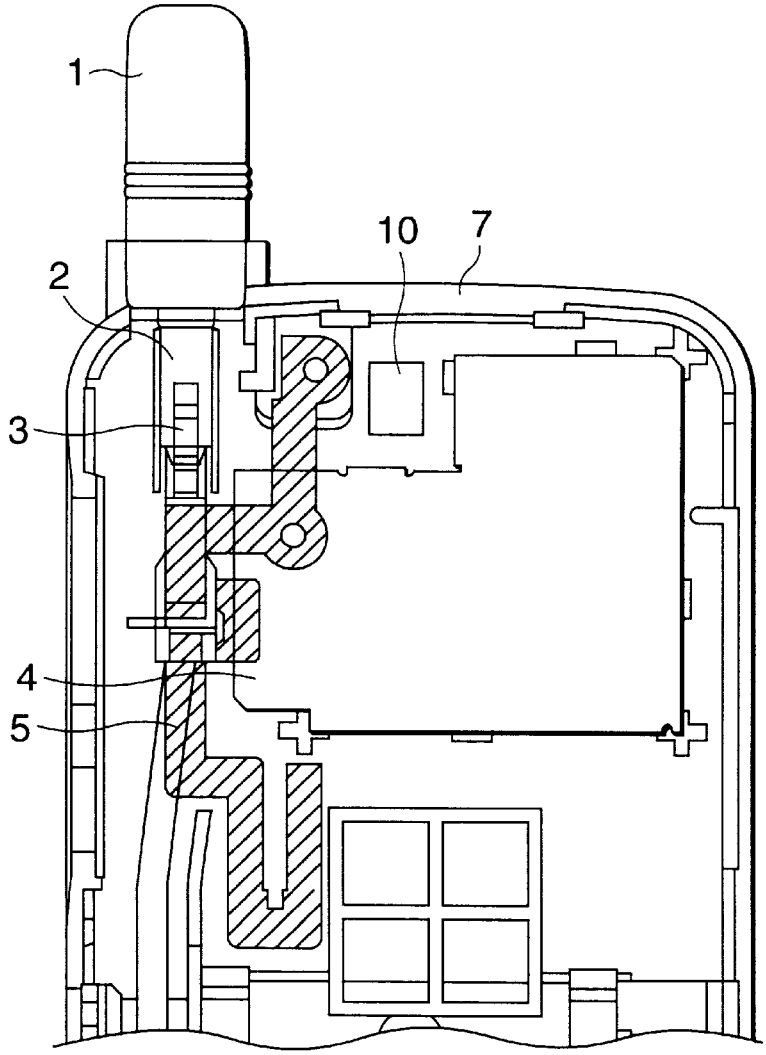

FIGS. 1A and 1B are diagrams showing the configuration of an antenna device of the invention. An entire view of the portable radio terminal device is not provided here, but only the part in the vicinity of the antenna device will be explained.

FIGS. 1A and 1B show the part in the vicinity of the antenna device in a portable radio terminal device, such as a PHS. FIG. 1A is a side view of the portable radio terminal device, and FIG. 1B is a plan view of the portable radio terminal device viewed from the front side. In FIGS. 1A and 1B, the antenna device comprises a retractable antenna having a helical part 1 with a helical antenna element in an antenna cover and a feeder part 2 provided in a housing 7, to be connected with the helical antenna element of the helical part, a radio circuit substrate 6 disposed in the housing 7, to be connected via a feeding spring 3 to be the feeding point of the antenna, a matching circuit part 10 for transmitting the electric power of a radio circuit part provided in the radio circuit substrate 6 to the antenna via the feeding spring 3 without reflection, a shield case 4 for shielding an unnecessary electromagnetic wave radiated from the radio circuit part provided in the radio circuit substrate 6, and a conductor element 5 elongating along the antenna storage part.

The conductor element 5 is for capacitive coupling with the antenna feeder part 2 in the space inside the housing 7 so as to serve as a radiation element by the electric current to be excited by the capacitive coupling.

Moreover, the conductor element 5 is disposed with a three-dimensional shape along the antenna storage part for allowing further capacitive coupling with the antenna feeder part.

Figure 2:
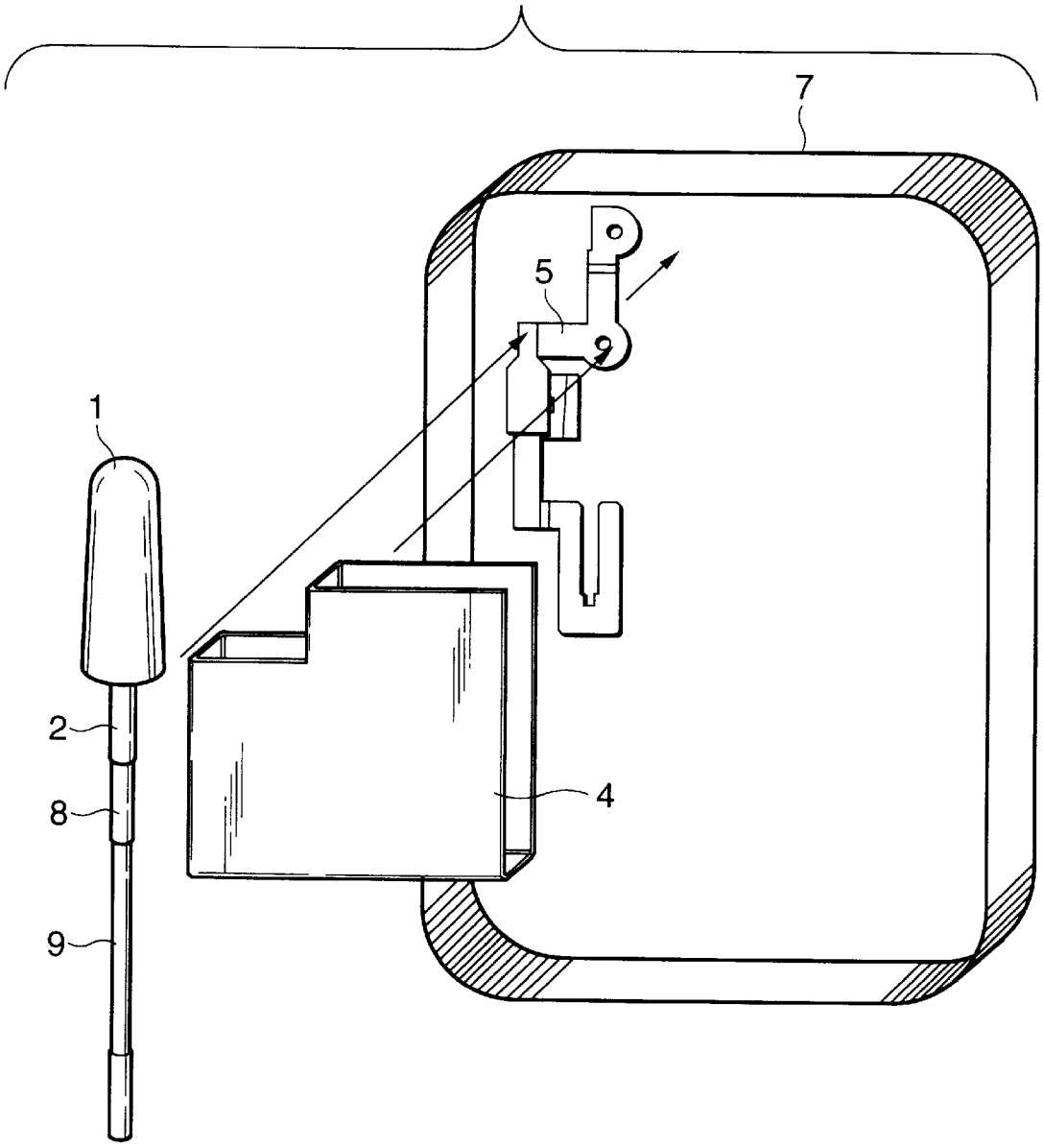
FIG. 2 is an exploded perspective view of principal components of an embodiment of the invention.
Figure 3:
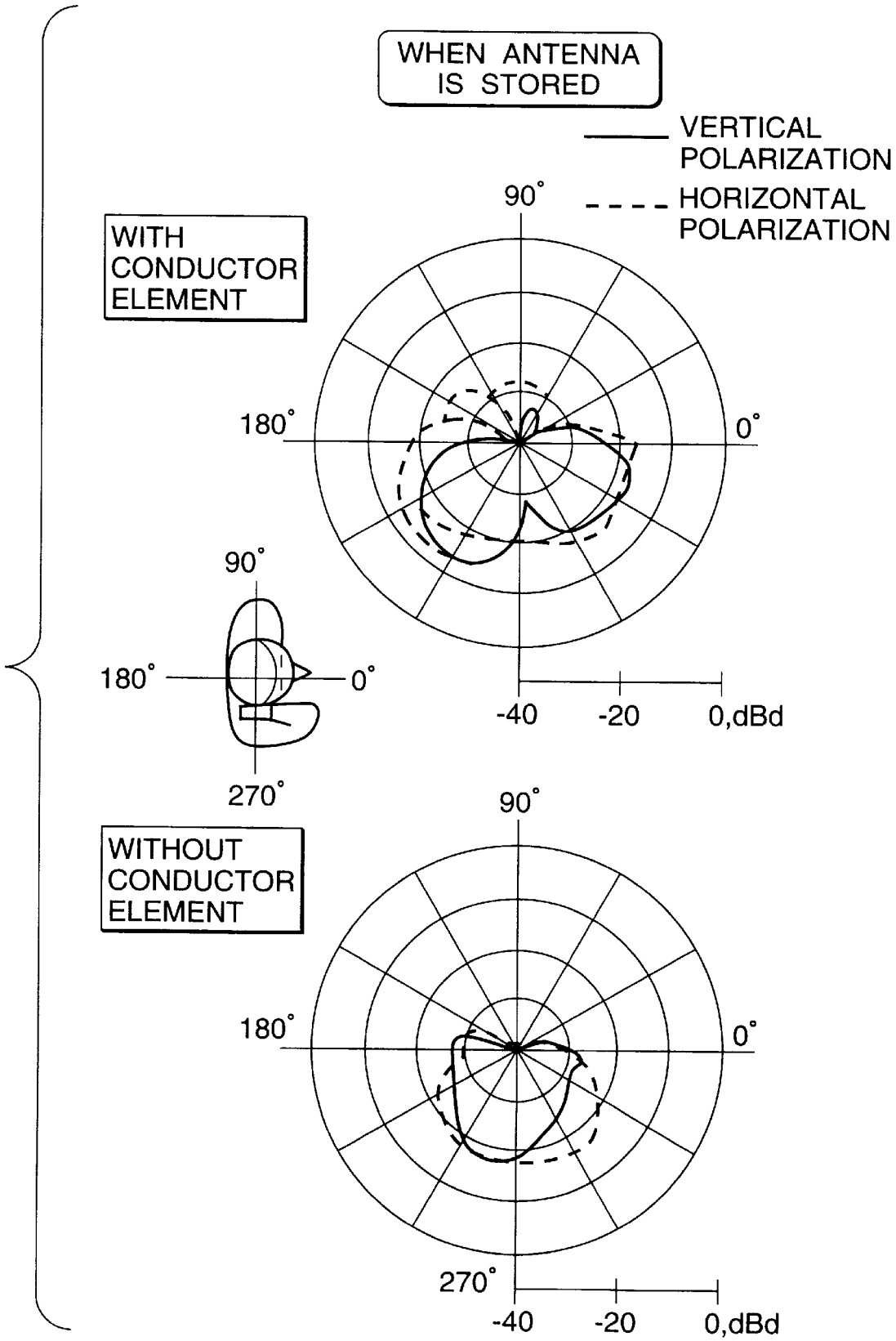
FIGS. 3A and 3B are graphs for comparing the antenna device according to the embodiment of the invention and a conventional antenna device in a vertical polarization component and a horizontal polarization component of the radiation field strength in a 360 degree horizontal plane radiated from a portable radio terminal device and measured by a receiving antenna provided at a distance 3 m away.

FIG. 2 is an exploded perspective view of principal components of the antenna device according to the embodiment of the invention. The principal components of the antenna device, that is, the retractable antenna comprising the helical part 1, the feeder part 2, a detaching part 8 and a whipping part 9, the shield case 4, and the conductor element 5 disposed with a three-dimensional shape along the antenna storage part for allowing further capacitive coupling with the antenna feeder part are shown disassembled and separated with respect to the housing 7. The arrow applied on each component shows the position at which the component is to be disposed.

FIGS. 3A and 3B are graphs for comparing the antenna device according to the embodiment of the invention and a conventional antenna device in a vertical polarization component and a horizontal polarization component of the radiation field strength in a 360 degree horizontal plane radiated from a portable radio terminal device with the portable circuit part in the transmitting state and the portable radio terminal device radiating an electromagnetic wave from the antenna disposed adjacent to a human head part in the state the same as having the conversation, and measured by a receiving antenna provided at a distance 3 m away.

It is observed that the radiation from the helical part 1 is slight due to the influence by the human head part in the case without the conductor element shown in FIG. 3B.

On the other hand, in the case the conductor element is provided as shown in FIG. 3A, it is observed that the radiation amount is increased owing to the radiation from the conductor element 5 in addition to that of the helical part 1. That is, by the comparison between FIGS. 3A and 3B, it is learned that the present invention has achieved the improvement as much as about 10 dBd.

Figure 4A:
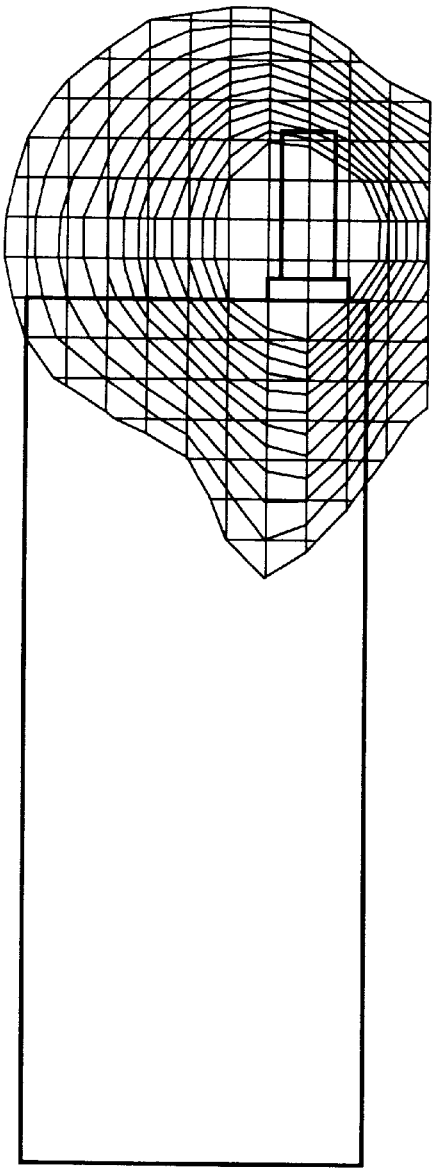
FIG. 4A is a diagram showing the measured field strength distribution in the vicinity of the antenna at the time of transmission with the antenna stored in the antenna device comprising the conductor element of the invention.

FIG. 4A is a diagram showing the measured field strength distribution in the vicinity of the antenna at the time of radiating the power (electromagnetic wave) from the antenna with the antenna comprising the conductor element of the invention stored in the antenna device in the transmission state. On the other hand, FIG. 4B is a diagram showing the measured field strength distribution in the vicinity of the antenna at the time of radiating the power (electromagnetic wave) from the antenna with the antenna stored in the conventional antenna device without the conductor element in the transmission state.

Figure 4B:
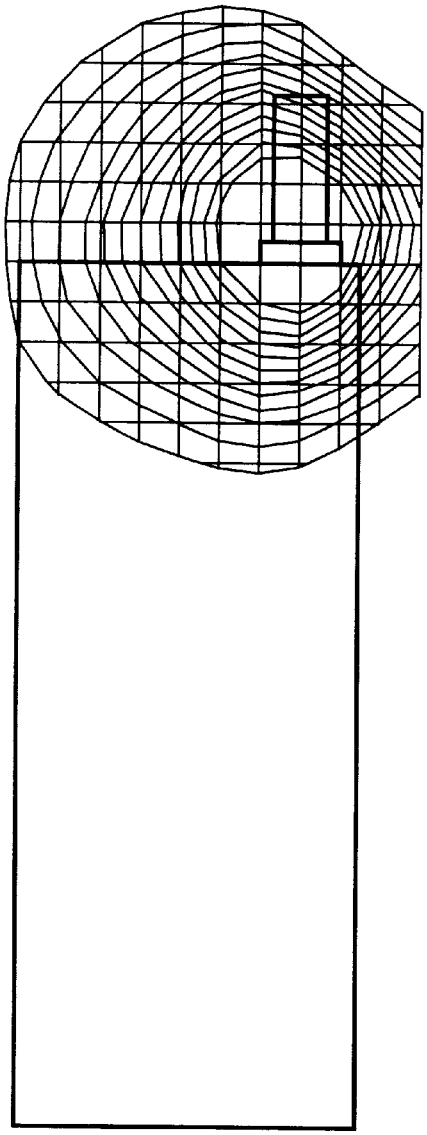
FIG. 4B is a diagram showing the measured field strength distribution in the vicinity of the antenna at the time of transmission with the antenna stored in the conventional antenna device without the conductor element.
Figure 5A:
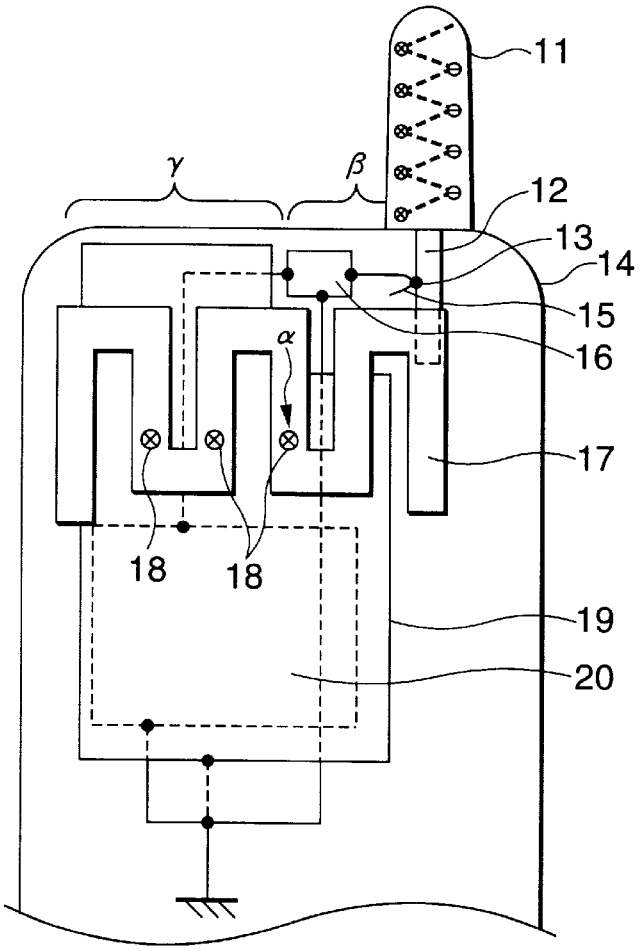
FIGS. 5A and 5B are diagrams showing the configuration of the antenna device according to the prior application.
Figure 5B:
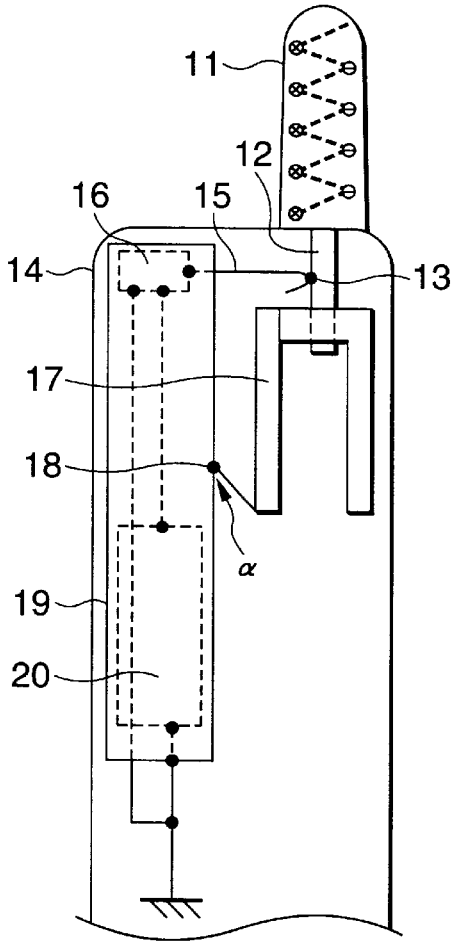

As shown in FIGS. 4A and 4B, in the case of the antenna device of the invention, the field strength spreads to the conductor element 5 so that it is leaned that the conductor element 5 serves as the radiation source whereas the field strength of the conventional antenna device without the conductor element is concentrated in the helical part.

Accordingly, it is apparent that by providing the conductor element 5, influence by the human head can be alleviated owing to the radiation from the conductor element 5 even when radiation from the helical part is restrained due to the approach of the human head so that the effect of improving the antenna characteristic is provided.

Although the case of a retractable antenna has been explained in the embodiment of the invention described above, it is not limited thereto, but it is easily understood by those skilled in the art that the invention is applied to fixed antennas used in a portable radio phone device to operate in the same manner as the retractable antenna at the time of contraction. Although a helical element commonly used is presented as the radiation element of the retractable antenna, it is not limited thereto but the invention is effective for other radiation elements. Moreover, the conductor element can be disposed two-dimensionally with the effect the same as the case of being disposed three-dimensionally as long as the space is sufficient. Furthermore, the conductor element is bent for saving the entire conductor length, and thus it is. not always needed to be bent as long as a sufficient space is secured.

As heretofore mentioned, since the invention is an antenna device comprising a retractable antenna provided with a shield case in a housing, wherein an antenna feeder part comes in contact with a feeding spring at the time of contraction so that a helical part can function as an antenna as well as a conductor element is provided elongating along an antenna storage part in the space in the housing for capacitive coupling with the antenna feeder part so that the antenna gain is improved by the conductor element, even when the radiation of the helical part is restrained by the influence of a human head part, in particular, of an earlobe, since the conductor element is the radiation source, it is easy to secure the space as well as a step for the conductance with other electric devices is not required, and restraint of the radiation by the human head part can be alleviated for the antenna device as a whole so that the effect of improving the antenna gain can be achieved.

What is claimed is:

1. An antenna device comprising:

a retractable antenna provided with a shield case in a housing;

a feeding spring which contacts an antenna feeder part at the time of contraction so that a radiation element can function as an antenna; and a conductor element elongating along an antenna storage part in a space in the housing for capacitive coupling with the antenna feeder part so that the antenna gain is improved by the conductor element.

2. The antenna device according to claim 1, wherein the conductor element is disposed with a three-dimensional shape along the antenna storage part for allowing further capacitive coupling with the antenna feeder part.

3. A portable radio terminal device comprising an antenna device including:

a retractable antenna provided with a shield case in a housing;

a feeding spring which contacts an antenna feeder part at the time of contraction so that a radiation element can function as an antenna; and a conductor elongating along an antenna storage part in a space in the housing for a capacitive coupling with the antenna feeder part so that the antenna gain is improved by the conductor element.

4. A portable radio phone device comprising an antenna device including:

a retractable antenna provided with a shield case in a housing;

a feeding spring which contacts an antenna feeder part at the time of contraction so that a radiation element can function as an antenna; and a conductor elongating along an antenna storage part in a space in the housing for a capacitive coupling with the antenna feeder part so that the antenna gain is improved by the conductor element.

5. An antenna device comprising:

a fixed antenna provided with a shield case in a housing;

an antenna feeder part which contacts with a feeding spring so that a radiation element can function as an antenna;

a conductor element elongating along a prolongation of the antenna feeder part in a space in the housing for capacitive coupling with the antenna feeder part so that the antenna gain is improved by the conductor element.

6. The antenna device according to claim 5, wherein the conductor element is disposed with a three-dimensional shape along the antenna storage part for allowing further capacitive coupling with the antenna feeder part.

7. A portable radio terminal device comprising an antenna device including:

a fixed antenna provided with a shield case in a housing;

an antenna feeder part which contacts with a feeding spring so that a radiation element can function as an antenna;

a conductor element elongating along a prolongation of the antenna feeder part in a space in the housing for capacitive coupling with the antenna feeder part so that the antenna gain is improved by the conductor element.

8. A portable radio phone device comprising an antenna device including:

a fixed antenna provided with a shield case in a housing;

an antenna feeder part which contacts with a feeding spring so that a radiation element can function as an antenna;

a conductor element elongating along a prolongation of the antenna feeder part in a space in the housing for capacitive coupling with the antenna feeder part so that the antenna gain is improved by the conductor element.

* * * * *